US006870118B2

(12) United States Patent
Nishijima et al.

(10) Patent No.: US 6,870,118 B2
(45) Date of Patent: Mar. 22, 2005

(54) CONTACT FOR VACUUM INTERRUPTER, AND VACUUM INTERRUPTER USING SAME

(75) Inventors: Akira Nishijima, Shizuoka (JP); Hidemitsu Takebuchi, Chiba (JP); Yoshihiko Matsui, Shizuoka (JP); Takaaki Furuhata, Shizuoka (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 0 days.

(21) Appl. No.: 10/736,585

(22) Filed: Dec. 17, 2003

(65) Prior Publication Data

US 2004/0124179 A1 Jul. 1, 2004

Related U.S. Application Data

(62) Division of application No. 10/238,901, filed on Sep. 11, 2002, now Pat. No. 6,686,552.

(30) Foreign Application Priority Data

Sep. 12, 2001 (JP) ..... 2001-276172
Sep. 17, 2001 (JP) ..... 2001-281068

(51) Int. Cl.[7] ..... H01H 33/66
(52) U.S. Cl. ..... 218/128; 218/129; 218/123
(58) Field of Search ..... 218/123–125, 218/126–128, 129

(56) References Cited

U.S. PATENT DOCUMENTS 4,532,391 A 7/1985 Bernt
4,620,074 A 10/1986 Paul et al.
5,313,030 A 5/1994 Kusserow et al.
5,691,522 A 11/1997 Schulman et al.
6,072,141 A * 6/2000 Slamecka ..... 218/127
2003/0066743 A1 4/2003 Nishijima et al.
2003/0080093 A1 5/2003 Matsui et al.

FOREIGN PATENT DOCUMENTS

| | | |
|---|---|---|
| DE | 37 24 813 A1 | 2/1989 |
| DE | 198 55 413 A1 | 7/1999 |
| EP | 0 199 594 A2 | 10/1985 |
| EP | 0 443 236 A1 | 8/1991 |
| EP | 0 615 263 A1 | 9/1994 |
| JP | 61-211926 A | 9/1986 |
| JP | 2-227923 A | 9/1990 |
| JP | 3-59531 B2 | 9/1991 |

* cited by examiner

*Primary Examiner*—Elvin Enad
*Assistant Examiner*—M. Fishman
(74) *Attorney, Agent, or Firm*—Foley & Lardner LLP

(57) ABSTRACT

A contact for a vacuum interrupter, includes: 1) a contact plate; and 2) a contact carrier. The contact carrier includes: a first end face which is fitted with the contact plate, and a peripheral face which is formed with a slit portion in such a manner as to form a coil part. The coil part flows a current such that a longitudinal magnetic field is formed in an axial direction of the contact carrier. The first end face fitted with the contact plate is formed with a circumferential slit portion which connects to the slit portion.

19 Claims, 11 Drawing Sheets

CONTACT FOR VACUUM INTERRUPTER, AND VACUUM INTERRUPTER USING SAME

This application is a Divisional of Ser. No. 10/238,901, filed Sep. 11, 2002, now U.S. Pat. No. 6,686,552.

BACKGROUND OF THE INVENTION

The present invention relates to a contact for a vacuum interrupter, and a vacuum interrupter using the contact.

For obtaining enhanced interrupting performance of the vacuum interrupter, electrodes need to receive arc produced therebetween at interruption (shutoff) by their entire surfaces without concentrating arc onto specific spots. The structure for forming a longitudinal magnetic field between electrodes, i.e. the longitudinal magnetic-field applying method, is adopted to receive arc by the entire surfaces of the electrodes. Generation of the longitudinal magnetic field between the electrodes encloses arc, leading to less loss of charged particles from an arc column, excellent arc stability, restrained temperature rise of the electrodes, and enhanced interrupting performance.

U.S. Pat. No. 4,620,074 (equivalent of Japanese Patent Examined Publication No. Heisei 3(1991)-59531 [=JP3059531B]) describes "a contact arrangement for vacuum switches" adopting the longitudinal magnetic field application method. A contact carrier in a form of a hollow cylinder has an end face which is formed with a contact plate. The contact carrier has a periphery formed with a slit (referred to as "slots" in ABSTRACT). Length (referred to as "predetermined height HT" in ABSTRACT), the number of slits, and an azimuth angle of the slit of the contact carrier are defined with respect to an outer diameter of the contact carrier.

FIG. 15 and FIG. 16 show a construction of a contact of a vacuum interrupter, according to U.S. Pat. No. 4,620,074.

A contact 01 has a contact carrier 02 and a contact end plate 03. The contact carrier 02 has a first end (lower end in FIG. 15) to which the contact end plate 03 is brazed. As a result, the contact 01 is shaped substantially into a cup. The contact carrier 02 has a second end (upper end in FIG. 15) to which a contact plate 04 is brazed. The contact carrier 02 has a periphery which is formed with a plurality of inclined slits 05 each of which is inclined by a predetermined angle. An area between two adjacent inclined slits 05 is defined as a coil part. Moreover, the contact plate 04 is formed with a slit 06 connecting to the inclined slit 05. The slit 06 is offset by a distance b from a center O of the contact 01. As is seen in FIG. 15, there is defined an inclination angle a of the inclined slit 05, relative to an axis of the contact 01. As is seen in FIG. 16, there is defined an azimuth angle β which is an opening angle of the inclined slit 05, with respect to the center O of the contact 01.

The vacuum interrupter using the above contact 01 shows the following features:

A current Ia flowing circumferentially around the contact 01 as is seen in FIG. 15 and a current Ib flowing spirally on the contract plate 04 as is seen in FIG. 16 secure a magnetic flux density between electrodes during current interruption. The magnetic flux density caused by the current Ib shows a concentrated distribution around an axis of the electrode, thereby causing a concentration of arc substantially in the center during the current interruption. The thus concentrated arc disables interruption of a great short circuit.

For interruption of a high voltage and a heavy current, larger coil diameter and greater gap between the contacts are required. In this case, however, the magnetic flux density between the electrodes is likely to become short, thus destabilizing the arc between the electrodes and leading to incapability of interruption.

Moreover, for securing the magnetic field, the azimuth angle β of the inclined slit 05 (formed in the contact carrier 02) needs to be greater. In this case, however, the contact 01 itself may become short in strength. Thereby, opening and closing the contacts 01 may deform the contacts 01, thereby deteriorating voltage withstandability as well as interrupting performance.

BRIEF SUMMARY OF THE INVENTION

It is an object of the present invention to provide a contact for a vacuum interrupter, and a vacuum interrupter using the contact.

According to a first aspect of the present invention, there is provided a contact for a vacuum interrupter, comprising: 1) a contact plate; and 2) a contact carrier. The contact carrier comprises: a first end face which is fitted with the contact plate, and a peripheral face which is formed with a slit portion in such a manner as to form a coil part. The coil part flows a current such that a longitudinal magnetic field is formed in an axial direction of the contact carrier. The first end face fitted with the contact plate is formed with a circumferential slit portion which connects to the slit portion.

According to a second aspect of the present invention, there is provided a vacuum interrupter, comprising: a first contact fixed to a peak end of a stationary rod which is fixed to a first end plate of a vacuum container; and a second contact fixed to a peak end of a movable rod which is fixed to a second end plate of the vacuum container opposite to the first end plate. The second contact opposes the first contact substantially coaxially in such a manner as to define a predetermined gap G therebetween in the following range: 15 mm≦G≦100 mm. Each of the first contact and the second contact, comprises: 1) a contact plate; and 2) a contact carrier. The contact carrier comprises: a first end face which is fitted with the contact plate, and a peripheral face which is formed with a slit portion in such a manner as to form a coil part. The coil part flows a current such that a longitudinal magnetic field is formed in an axial direction of the contact carrier. The first end face fitted with the contact plate is formed with a circumferential slit portion which connects to the slit portion.

According to a third aspect of the present invention, there is provided a contact for a vacuum interrupter, comprising: 1) a plate; 2) a carrier having a first end face mounted to the plate; and 3) slits formed in the carrier. The slits define a coil portion in the carrier. A current passing through the coil portion generates a longitudinal magnetic field along an axial direction of the carrier. The slits comprise a first slit which comprises: a circumferential slit portion formed in the first end face of the carrier, and an inclined slit portion formed in a peripheral face of the carrier at a predetermined inclination angle α with respect to an axis of the carrier and connected to an end of the circumferential slit portion.

According to a fourth aspect of the present invention, there is provided a vacuum interrupter, comprising two contacts disposed coaxially to oppose each other. A predetermined gap G between the two contacts is given by 15 mm≦G≦100 mm. Each of the two contacts comprises: 1) a plate; 2) a carrier having a first end face mounted to the plate; and 3) slits formed in the carrier. The slits define a coil portion in the carrier. A current passing through the coil portion generates a longitudinal magnetic field along an axial direction of the carrier. The slits comprise a first slit which comprises: a circumferential slit portion formed in the first end face of the carrier, and an inclined slit portion formed in a peripheral face of the carrier at a predetermined inclination angle $\alpha$ with respect to an axis of the carrier and connected to an end of the circumferential slit portion.

According to a fifth aspect of the present invention, there is provided a contact for a vacuum interrupter, comprising: 1) a plate; 2) a carrier having a first end face mounted to the plate; and 3) means for forming slits in the carrier. The forming means defines a coil portion in the carrier. A current passing through the coil portion generates a longitudinal magnetic field along an axial direction of the carrier. The forming means comprises a first slit which comprises: a circumferential slit portion formed in the first end face of the carrier, and an inclined slit portion formed in a peripheral face of the carrier at a predetermined inclination angle $\alpha$ with respect to an axis of the carrier and connected to an end of the circumferential slit portion.

The other objects and features of the present invention will become understood from the following description with reference to the accompanying drawings.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part of element is illustrated.

Figure 1:
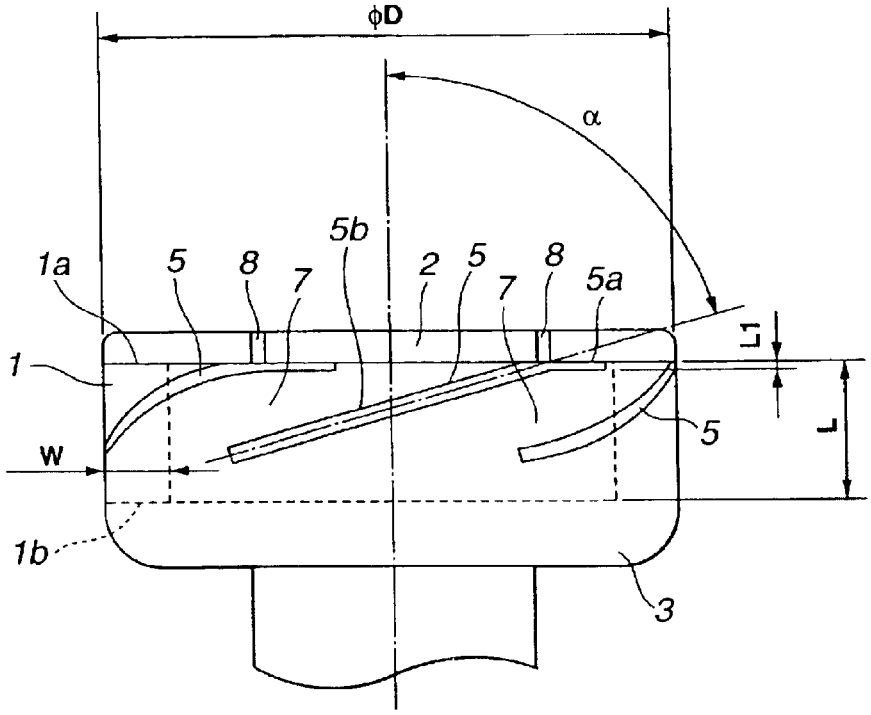
FIG. 1 is a side view of a contact for a vacuum interrupter, according to a first embodiment of the present invention.
Figure 2:
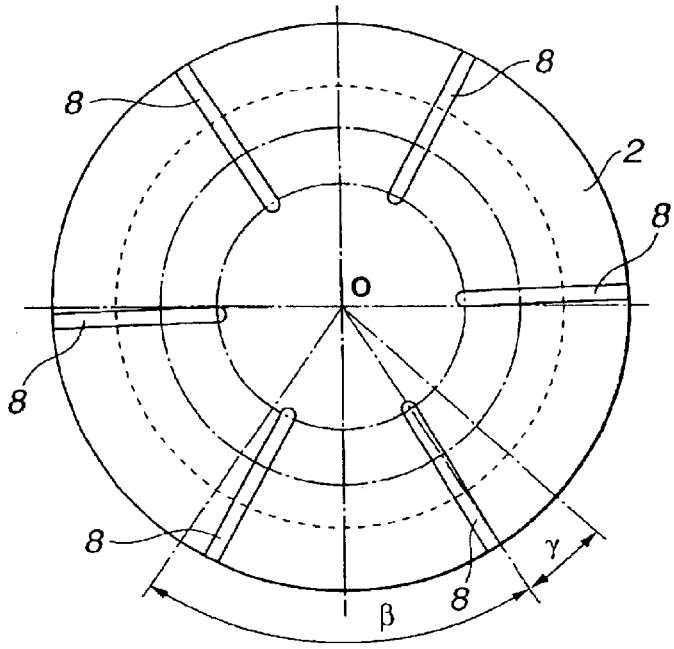
FIG. 2 is a plan view of the contact for the vacuum interrupter shown in FIG. 1.

As is seen in FIG. 1 and FIG. 2, there is provided a contact for a vacuum interrupter, according to a first embodiment of the present invention. FIG. 1 shows a side view while FIG. 2 shows a plan view of the contact for the vacuum interrupter.

A tubular (cylindrical) contact carrier 1 has a first end face 1*a* to which a contact plate 2 is brazed. The contact carrier 1 has a second end face 1*b* to which a contact end plate 3 connecting to a lead rod (i.e. stationary rod 17 and movable rod 19 in FIG. 3, to be described afterward) is brazed. The tubular contact carrier 1 and the contact end plate 3 are in combination formed substantially into a cup.

The contact carrier 1 defines an outer diameter D which can be determined in accordance with interrupting current and voltage in the following range: $60\ \text{mm} \leqq D \leqq 200\ \text{mm}$. The contact carrier 1 defines a length L (in other words, pot depth) which can be set up in the following rage: $0.1D\ \text{mm} \leqq L \leqq 0.5D\ \text{mm}$. Moreover, the contact carrier 1 defines a wall thickness W which can be set up in the following range: $6\ \text{mm} \leqq W \leqq 12\ \text{mm}$.

The tubular contact carrier 1 has an entire periphery which is formed with an inclined slit portion 5*b* defining an inclination angle $\alpha$ relative to an axis of the contact carrier 1. The inclined slit portion 5*b* is open to the first end face 1*a* of the contact carrier 1. The first end face 1*a* of the contact carrier 1 is formed with a circumferential slit portion 5*a* which connects to the inclined slit portion 5*b*, has a depth L1 and extends circumferentially. Hereinabove, the circumferential slit portion 5*a* and the inclined slit portion 5*b* in combination constitute a first slit 5. A coil part 7 is defined as an area interposed between the two adjacent inclined slit portions 5*b*.

The inclined slit portion 5*b* can be defined in number (number S1) in the following range: $0.03D/\text{mm} \leqq S1 \leqq 0.1D/\text{mm}$.

With mechanical strength and resistance reduction of the contact carrier 1 taken into account, the inclination angle $\alpha$ of the inclined slit portion 5*b* can be set up in the following range: $60° \leqq \alpha \leqq 80°$.

An azimuth angle $\beta$ of the inclined slit portion 5*b* can be set up in the following range: $45° \leqq \beta \leqq 120°$. The lower limit 45° of the azimuth angle $\beta$ is for securing sufficient magnetic flux density, while the upper limit 120° of the azimuth angle $\beta$ is for preventing heat generation which may be caused by resistance.

With mechanical strengths of the contact carrier 1 and the contact plate 2 taken into account, an azimuth angle $\gamma$ of the circumferential slit portion 5*a* can be set up in the following range: $(30/S1)° \leqq \gamma \leqq (270/S1)°$.

As is seen in FIG. 2, the contact plate 2 is formed with a substantially linear slit 8 extending radially. According to the first embodiment, the linear slit 8 connects to a section connecting the circumferential slit portion 5*a* and the inclined slit portion 5*b*, as is seen in FIG. 1.

According to the first embodiment, the second end face 1*b* of the tubular contact carrier 1 is so joined with the contact end plate 3 as to form the cup. Instead of the joint, a section corresponding to the contact end plate 3 can be monolithic with the contact carrier 1. In this case, however, the monolithic cup has a pot depth that is substantially equivalent to the length L of the contact carrier 1.

Figure 3:
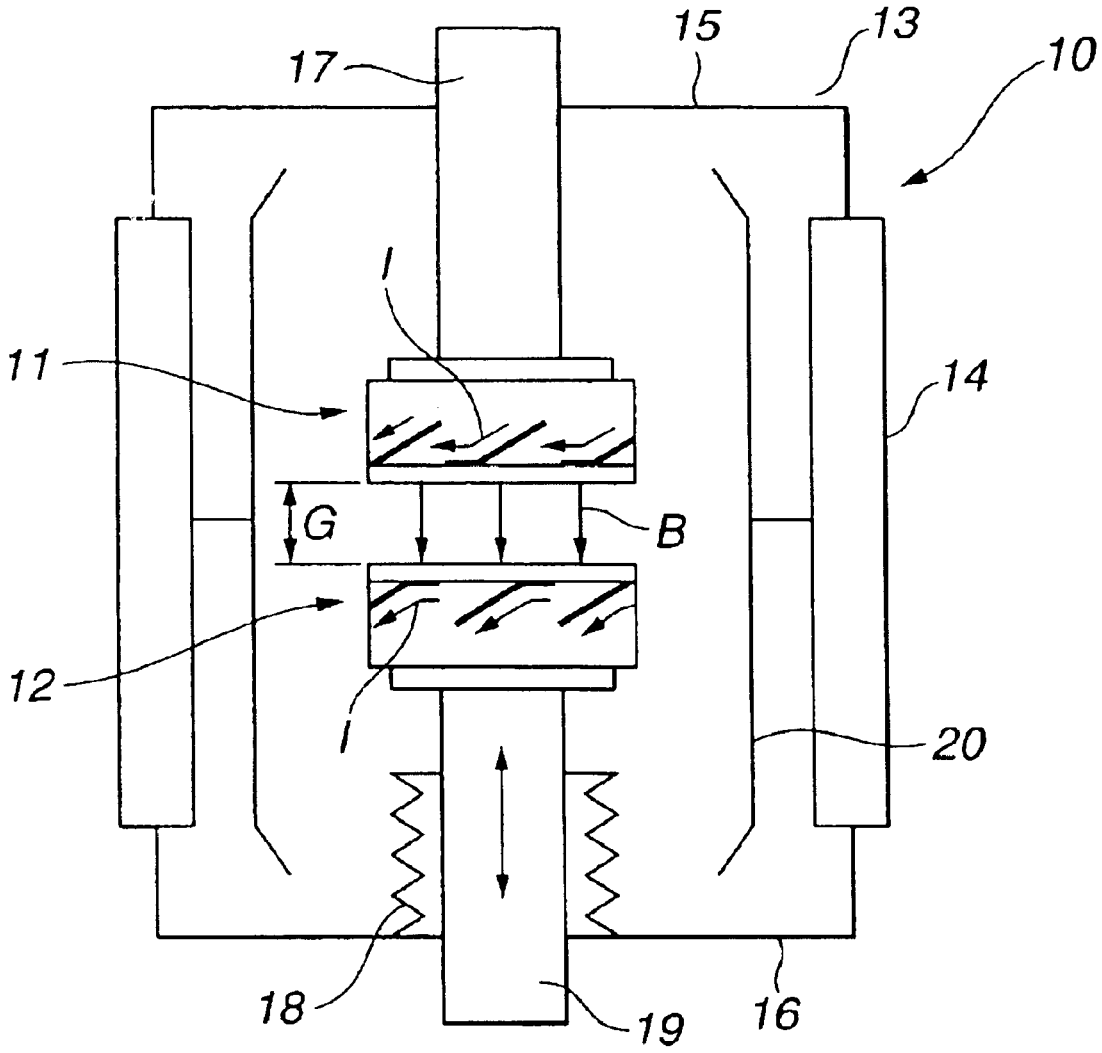
FIG. 3 shows a schematic of a vacuum interrupter 10 using the contact for the vacuum interrupter shown in FIG. 1 and FIG. 2.

As is seen in FIG. 3, there is provided a schematic of the vacuum interrupter 10 which is constituted of the contacts described above. More specifically, there is shown in FIG. 3, a pair of a first contact 11 and a second contact 12 each of which has a construction as is seen in FIG. 1 and FIG. 2. There is defined a predetermined gap G between the first contact 11 and the second contact 12, in such a manner that the first contact 11 and the second contact 12 can oppose each other coaxially in a vacuum container 13. The gap G can be defined in the following range: 15 mm≦G≦100 mm.

The vacuum container 13 has such a construction that an insulating tube 14 made of ceramic, glass and the like has a first end blocked by a first end plate 15 and a second end blocked by a second end plate 16. With the above construction, high vacuum state can be kept inside the vacuum container 13. The first contact 11 is fixed to a peak end (lower end in FIG. 3) of a stationary rod 17 which is fixed via the first end plate 15 of the vacuum container 13. Thereby, the first contact 11 acts as a stationary electrode. On the other hand, the second contact 12 is fixed to a peak end (upper end in FIG. 3) of a movable rod 19 which is disposed via the second end plate 16 in such a manner as to move by means of a bellows 18. Thereby, the second contact 12 acts as a movable contact. In the vacuum container 13, there is provided a shield 20 around the first contact 11 and the second contact 12.

In the vacuum interrupter 10 constructed above, an arc is generated between the electrodes, that is, the first contact 11 and the second contact 12 when current is interrupted.

On the other hand, a current I can take the following route:

With the circumferential slit portion 5*a* (insulating layer) formed between the contact plate 2 and the contact carrier 1, the current I flows whiningly along the contact plate 2. Then, the current I enters the coil part 7 between the two adjacent inclined slit portions 5*b* of the contact carrier 1, thus causing a longitudinal magnetic filed B. A current path formed by the inclined slit portion 5*b* in combination with the circumferential slit portion 5*a* is longer than a current path formed by the inclined slit portion 5*b* only. Thereby, the former can cause greater magnetic field than the latter. As a result, the circumferential slit portion 5*a* can help stabilize the arc, to thereby improve interrupting performance.

According to the first embodiment, each of the first contact 11 and the second contact 12 of the vacuum interrupter 10 as shown in FIG. 3 defines the following dimensions:

EXAMPLE 1

| | |
|---|---|
| 1. Outer diameter D of contact carrier 1: | 70 mm |
| 2. Length L of contact carrier 1: | 17 mm |
| 3. The number S1 of inclined slit portions 5b: | 6 |
| 4. Inclination angle α of inclined slit portion 5b: | 68° |
| 5. Azimuth angle β of inclined slit portion 5b: | 90° |
| 6. Azimuth angle γ of circumferential slit portion 5a: | 15° |
| 7. Wall thickness W of contact carrier 1: | 7.5 mm |

With the first contact 11 and the second contact 12 oppositely disposed coaxially in such a manner as to form therebetween the gap G of 16 mm in the Example 1, the vacuum interrupter 10 (FIG. 3) generates the magnetic flux density of 4.0 μT/A substantially in the center. According to the first embodiment, the vacuum interrupter 10 can generate an interruption capacity featuring rated voltage of 36 kV and rated interrupting current of 31.5 kA.

Figure 4:
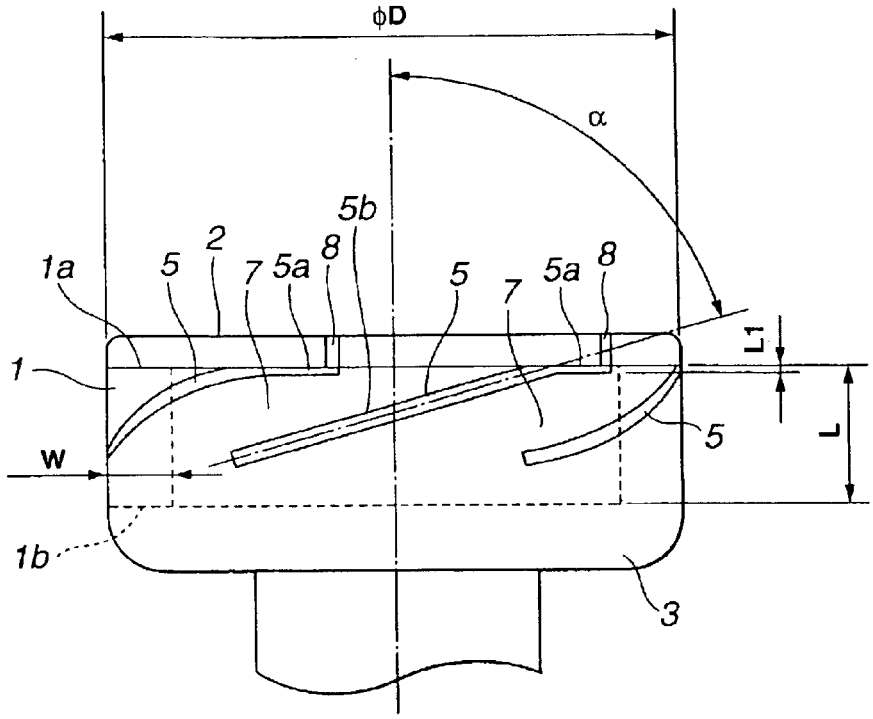
FIG. 4 is a side view of a contact for a vacuum interrupter, according to a second embodiment of the present invention.
Figure 5:
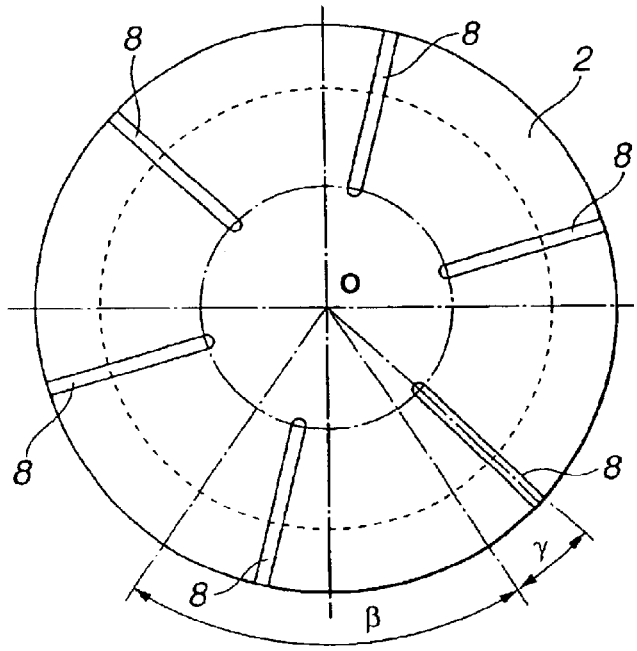
FIG. 5 is a plan view of the contact for the vacuum interrupter shown in FIG. 4.

As is seen in FIG. 4 and FIG. 5, there is provided a contact for a vacuum interrupter, according to a second embodiment of the present invention. FIG. 4 shows a side view while FIG. 5 shows a plan view of the contact of the vacuum interrupter.

According to the second embodiment, the linear slit 8 disposed at the contact plate 2 connects to an initial end (first end, or right end in FIG. 4) of the circumferential slit portion 5*a*, instead of the section connecting the circumferential slit portion 5*a* and the inclined slit portion 5*b* according to the first embodiment. The other constructions according to the second embodiment are substantially the same as those according to the first embodiment.

According to the second embodiment, each of the first contact 11 and the second contact 12 of the vacuum interrupter 10 as shown in FIG. 3 defines the following dimensions:

EXAMPLE 2

| | |
|---|---|
| 1. Outer diameter D of contact carrier 1: | 80 mm |
| 2. Length L of contact carrier 1: | 20 mm |
| 3. The number S1 of inclined slit portions 5b: | 6 |
| 4. Inclination angle α of inclined slit portion 5b: | 72° |
| 5. Azimuth angle β of inclined slit portion 5b: | 90° |
| 6. Azimuth angle γ of circumferential slit portion 5a: | 15° |
| 7. Wall thickness W of contact carrier 1: | 7.5 mm |

With the first contact 11 and the second contact 12 oppositely disposed coaxially in such a manner as to form therebetween the gap G of 16 mm in the Example 2, the vacuum interrupter 10 (FIG. 3) generates the magnetic flux density of 3.6 μT/A substantially in the center. According to the first embodiment, the vacuum interrupter 10 can generate the interruption capacity featuring rated voltage of 36 kV and rated interrupting current of 31.5 kA.

Figure 6:
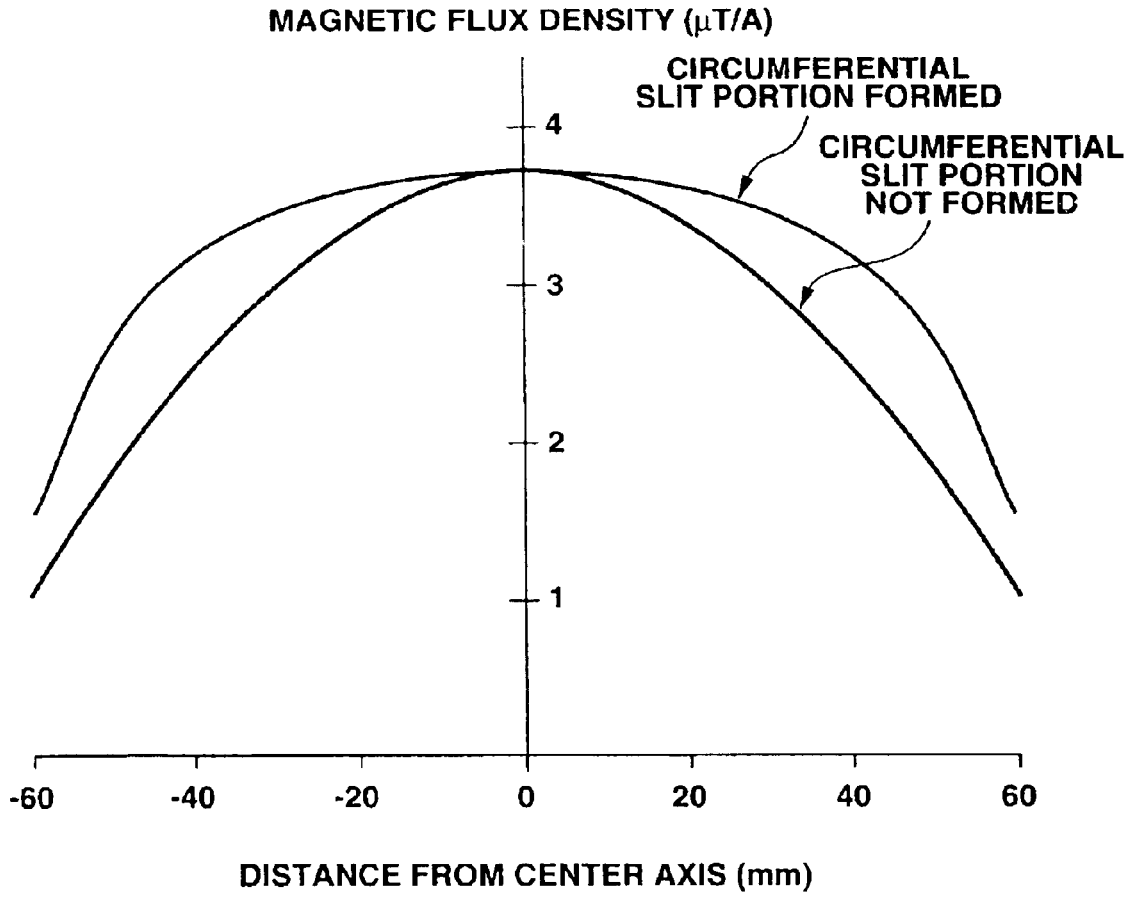
FIG. 6 is a graph showing magnetic flux density compared between the vacuum interrupter using the contact (for the vacuum interrupter) which is formed with a circumferential slit portion 5*a* and the one without the circumferential slit portion 5*a;*

FIG. 6 shows a distribution of the magnetic flux density. More specifically, FIG. 6 shows a comparison of the magnetic flux density between the vacuum interrupter using the contact formed "with" the circumferential slit portion 5*a* and the one using the contact "without" the circumferential slit portion 5*a*. An abscissa in FIG. 6 indicates a distance (mm) from the center of the electrode (i.e. first contact 11 and second contact 12), while an ordinate in FIG. 6 indicates the magnetic flux density (μT/A).

As is obvious from FIG. 6, the vacuum interrupter using the contact formed "with" the circumferential slit portion 5*a* can feature flatter magnetic flux density from the center of the electrode than the one using the contact "without" the circumferential slit portion 5*a*. In other words, the magnetic flux density of the former is high in a wider range than the magnetic flux density of the latter.

Figure 7:
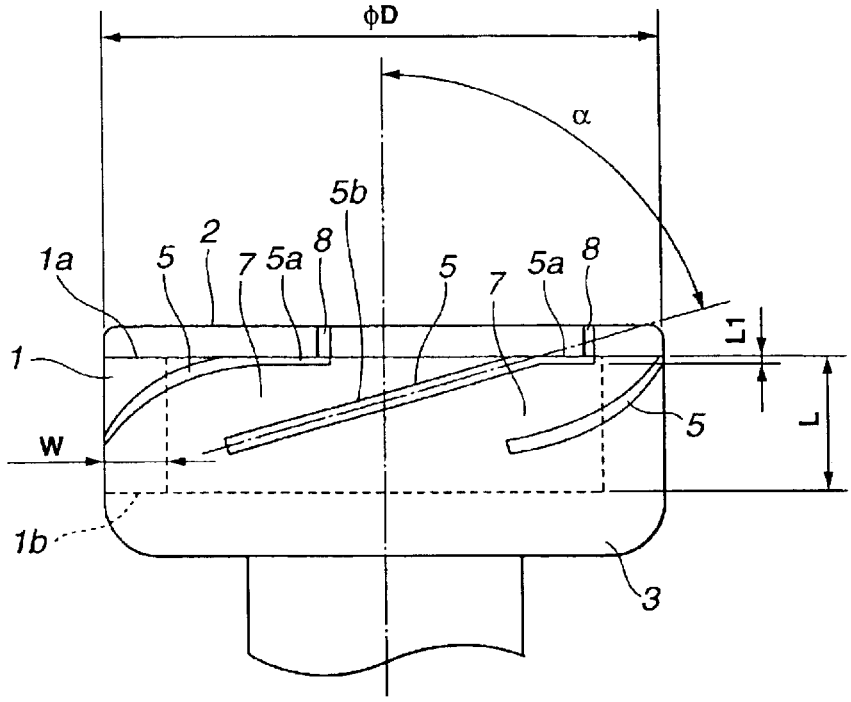
FIG. 7 is a side view of a contact for a vacuum interrupter, according to a third embodiment of the present invention.
Figure 8:
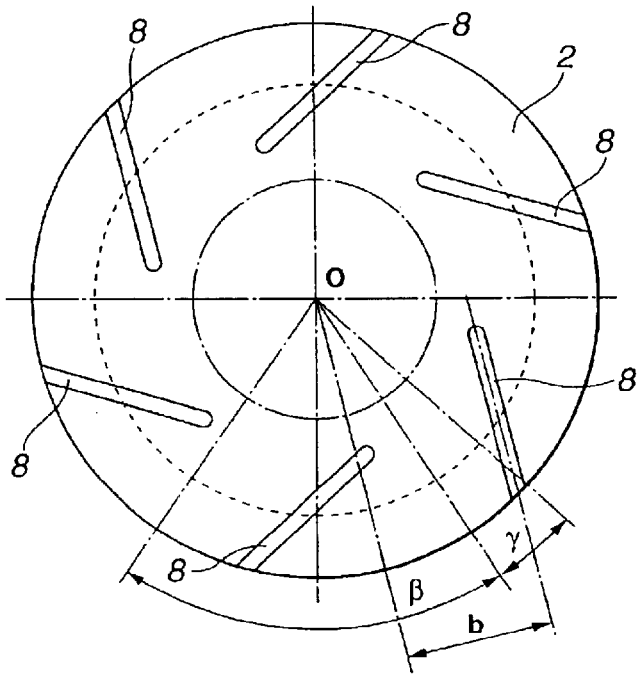
FIG. 8 is a plan view of the contact for the vacuum interrupter shown in FIG. 7.

As is seen in FIG. 7 and FIG. 8, there is provided a contact for a vacuum interrupter, according to a third embodiment of the present invention. FIG. 7 shows a side view while FIG. 8 shows a plan view of the contact for the vacuum interrupter.

According to the third embodiment, the linear slit 8 disposed at the contact plate 2 extends in such a manner as to be offset from a radial line passing through a center O of the contact plate 2. More specifically, as is seen in FIG. 8, the linear slit 8 extends substantially in parallel with the radial line, in such a manner as to be spaced apart from the radial line by a distance b. With this, overall construction of the linear slits 8 is shaped substantially into a spiral. An end of the linear slit 8 connects to the initial end (first end, or right end in FIG. 7) of the circumferential slit portion 5*a*. The other constructions according to the third embodiment are substantially the same as those according to the first embodiment.

According to the third embodiment, each of the first contact 11 and the second contact 12 of the vacuum interrupter 10 as shown in FIG. 3 defines the following dimensions:

EXAMPLE 3

| | |
|---|---|
| 1. Outer diameter D of contact carrier 1: | 90 mm |
| 2. Length L of contact carrier 1: | 21 mm |
| 3. The number S1 of inclined slit portions 5b: | 6 |
| 4. Inclination angle α of inclined slit portion 5b: | 75° |
| 5. Azimuth angle β of inclined slit portion 5b: | 102° |
| 6. Azimuth angle γ of circumferential slit portion 5a: | 15° |
| 7. Wall thickness W of contact carrier 1: | 8 mm |

With the first contact 11 and the second contact 12 oppositely disposed coaxially in such a manner as to form therebetween the gap G of 40 mm in the Example 3, the vacuum interrupter 10 (FIG. 3) generates the magnetic flux density of 3.5 μT/A substantially in the center. According to the third embodiment, the vacuum interrupter 10 can generate the interruption capacity featuring rated voltage of 72 kV and rated interrupting current of 31.5 kA. The magnetic flux density of 3.5 μT/A (substantially in the center) brought about in the Example 3 according to the third embodiment is about 1.25 times the one obtained by the vacuum interrupter 10 without the circumferential slit portion 5*a*.

Figure 9:
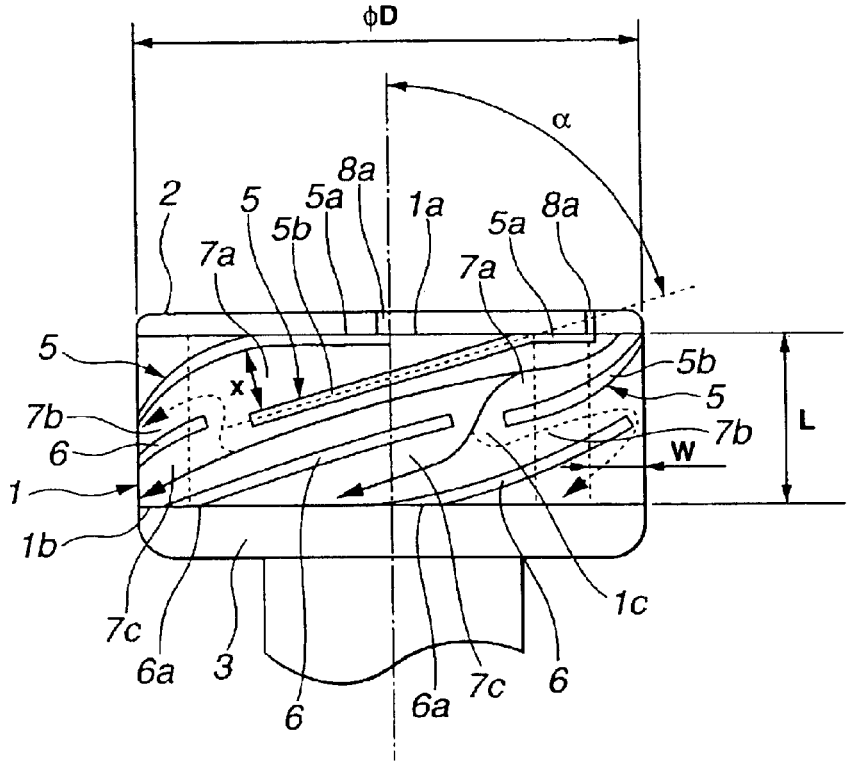
FIG. 9 is a side view of a contact for a vacuum interrupter, according to a fourth embodiment of the present invention.
Figure 10:
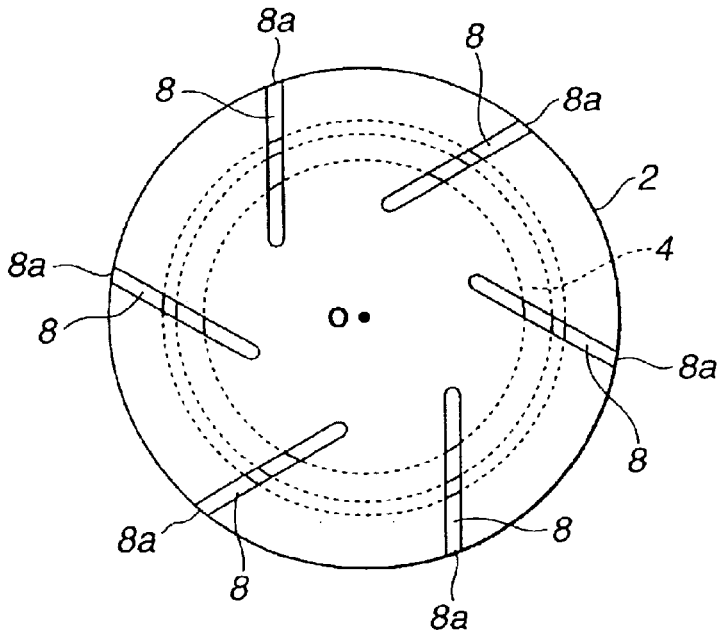
FIG. 10 is a plan view of the contact for the vacuum interrupter shown in FIG. 9.
Figure 11:
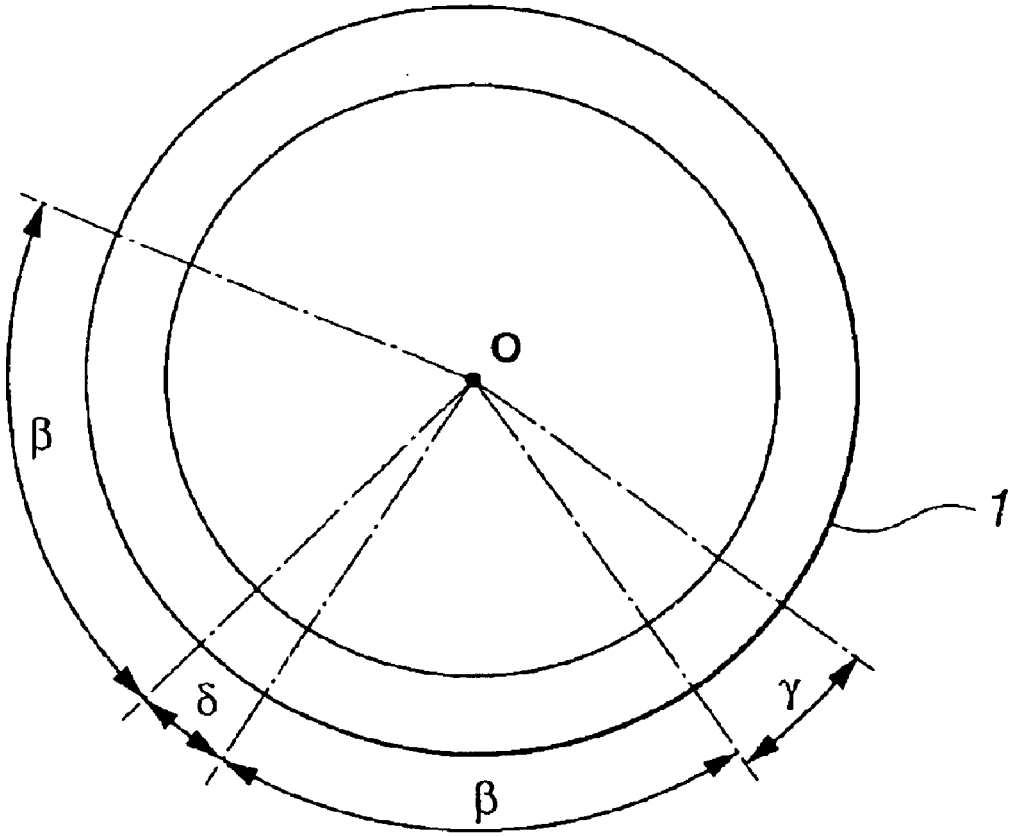
FIG. 11 is a schematic explaining azimuth angles of the contact in FIG. 9.
Figure 12:
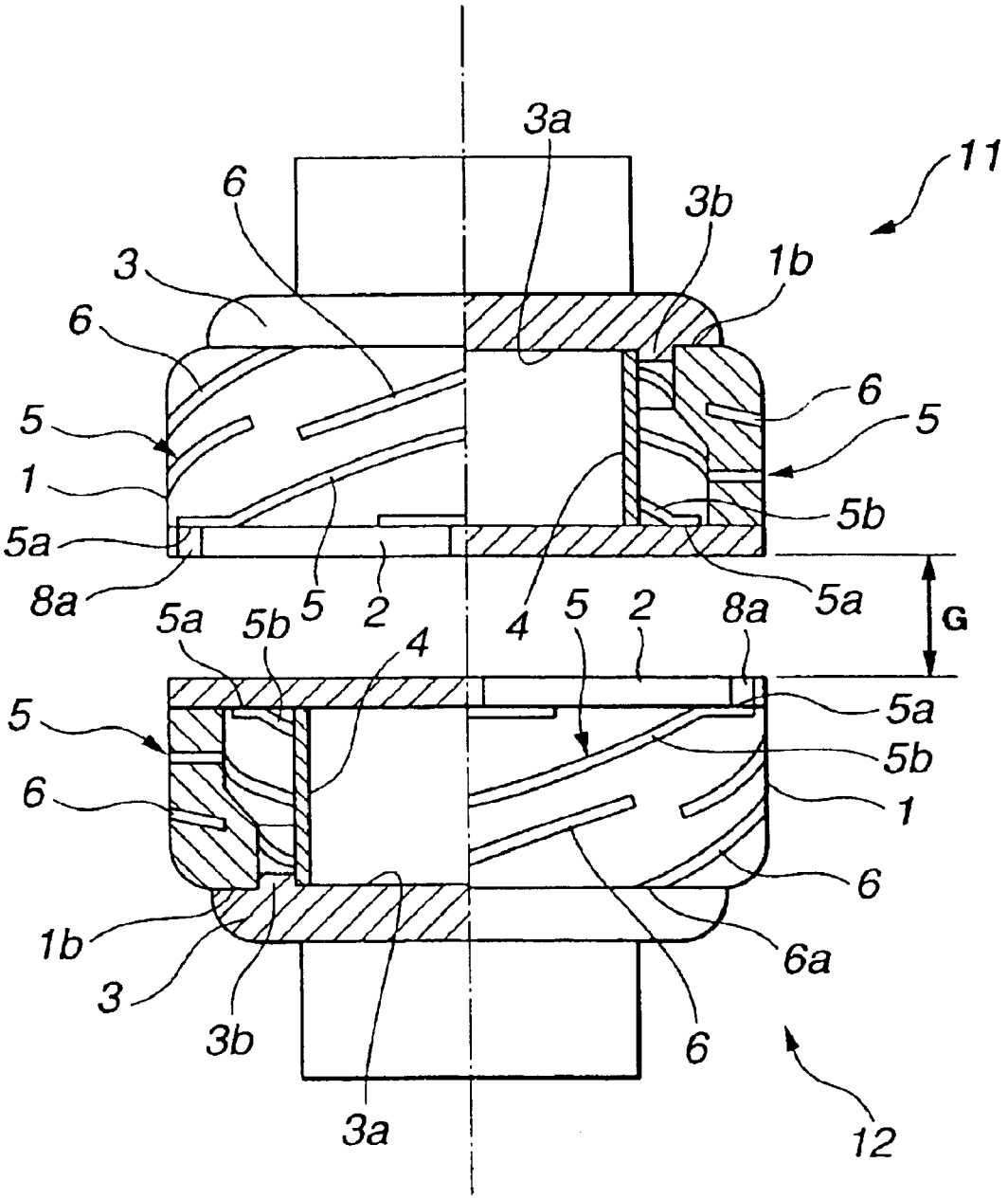
FIG. 12 is a view similar to FIG. 9, partly in section, showing the two contacts opposing each other.
Figure 13:
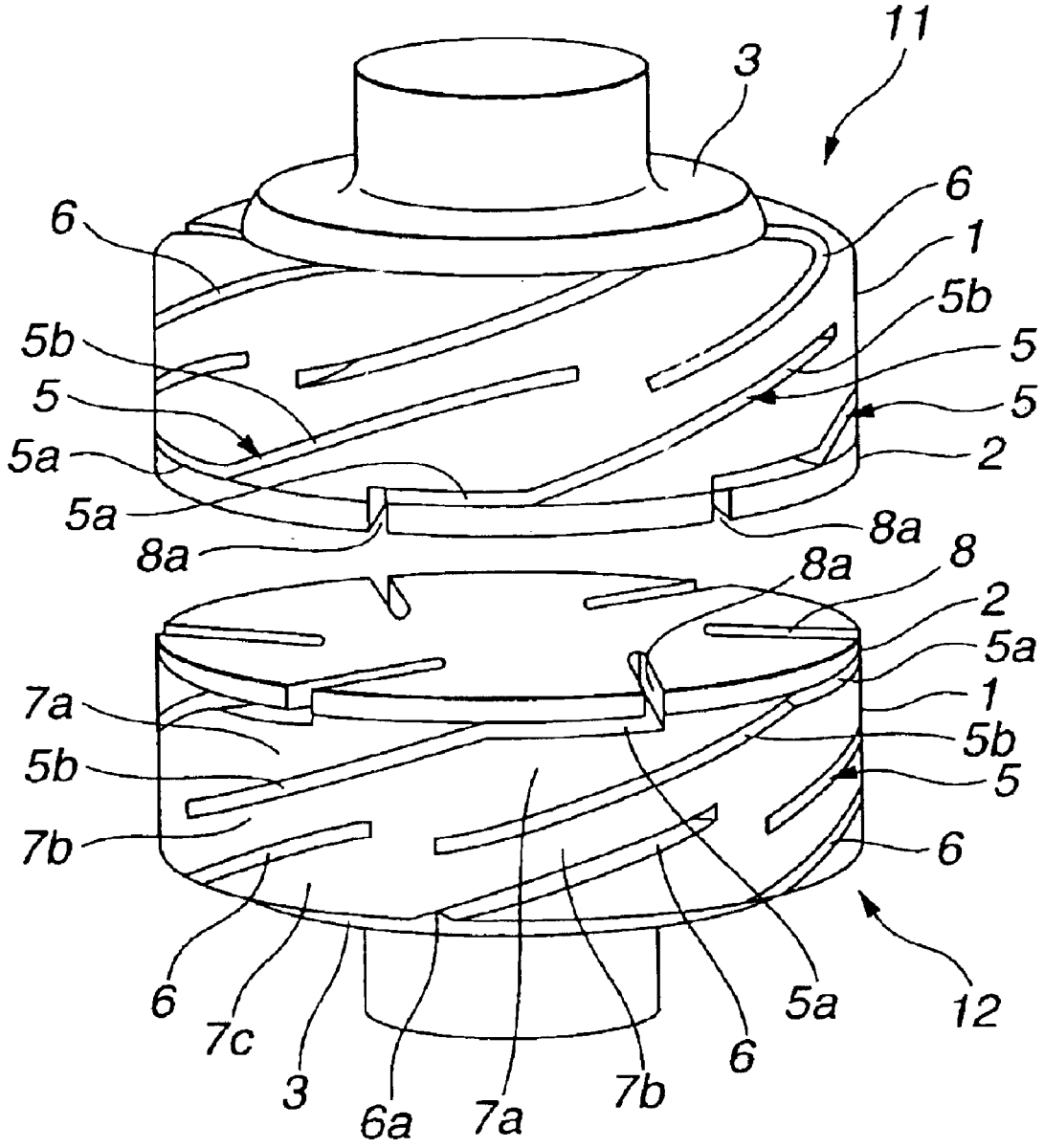
FIG. 13 is a perspective view showing the two contacts in FIG. 12.

As is seen in FIG. 9 to FIG. 13, there is provided a contact for a vacuum interrupter, according to a fourth embodiment of the present invention. FIG. 9 shows a side view while FIG. 10 shows a plan view of the contact for the vacuum interrupter. Moreover, FIG. 11 shows the azimuth angle β, the azimuth angle γ and an azimuth angle δ, while FIG. 12 and FIG. 13 show the contacts (for the vacuum interrupter) opposing each other.

As is seen in FIG. 9 to FIG. 13, the first contact 11 (likewise, the second contact 12) comprises the contact carrier 1 formed like a hollow cylinder and having the first end face 1*a* to which the contact plate 2 is brazed and the second end face 1*b* to which the contact end plate 3 with the lead rod (i.e. stationary rod 17 and movable rod 19 in FIG. 14, to be described afterward) connected is brazed. According to the fourth embodiment, as is seen in FIG. 12, a ring-like engagement 3*b* is formed in a surface 3*a* of the contact end plate 3, and is fitted inside the contact carrier 1 for brazing. A cylindrical reinforce 4 has an end fitted inside the ring-like engagement 3*b* of the contact end plate 3. The contact plate 2 fixed to the first end face 1*a* of the contact carrier 1 by brazing abuts on an end face of the cylindrical reinforce 4 for brazing. Specifically, the cylindrical reinforce 4 reinforces the contact plate 2 and the contact carrier 1 to prevent deformation thereof. Since the cylindrical contact carrier 1 and the contact end plate 3 are shaped like a cup, the first contact 11 (likewise, the second contact 12) is referred to as "cup type contact".

The outer diameter D of the contact carrier 1 is selected within the range of 60 mm≦D≦200 mm in accordance with the interrupting current and voltage. This range is determined based on a result of current interruption tests. The length L (in other words, pot depth) of the contact carrier 1 is set within the range of 0.2D mm≦L≦D mm, which is determined in accordance with the inclination angle α and the azimuth angle β as will be described later. The wall thickness W of the contact carrier 1 is set within the range of 6 mm≦W≦12 mm, which is determined in view of the strength, etc. With the first contact 11 (likewise, second contact 12) as shown in FIG. 9, the wall thickness W of the contact carrier 1 is uniform along the overall length. Optionally, for the purpose of reinforcement, etc., the wall thickness W may be varied in the range of 6 mm≦W≦12 mm as shown in FIG. 12.

The cup-like contact carrier 1 is formed with the first slits 5 and second slits 6. The first slit 5 comprises the circumferential slit portion 5*a* formed circumferentially in the first end face 1*a* of the contact carrier 1, and the inclined slit portion 5*b* formed in the peripheral face of the contact carrier 1 at the inclination angle α with respect to the axis of the contact carrier 1 and connected to the end of the circumferential slit portion 5*a*. The second slit 6 extends from the second end face 1*b* of the contact carrier 1 to near the axially middle position thereof. More specifically, the second slit 6 has an opening 6*a* at the second end face 1*b* as shown in FIG. 9 and FIG. 12. As is seen in FIG. 11, the azimuth angle β (or open angle) of the inclined slit portion 5*b* of the first slit 5 with respect to the center O of the contact carrier 1 is constant. The above azimuth angle β which is constant is also an open angle of the second slit 6 with respect to the center O of the contact carrier 1. A part located between the inclined slit portion 5*b* (of the first slit 5) and the second slit 6 constitutes a coil part. More specifically, a part located between the two adjacent inclined slit portions 5*b* (of the first slit 5) constitutes a first coil part 7*a*, a part located between the inclined slit portion 5*b* (of the first slit 5) and the second slit 6 constitutes a second coil part 7*b*, and a part located between the two adjacent second slits 6 constitutes a third coil part 7*c*.

The total number S2 of first slits 5 (inclined slit portions 5*b*) and second slits 6 is set within the range of 0.1D/mm≦S2≦0.2D/mm. In other words, the number of first slits 5 is ½ S2 , while the number of second slits 6 is ½ S2 . The inclination angle α of the inclined slit portion 5*b* (of the first slit 5) and the second slit 6 is set within the range of 60°≦α≦80°, which is determined in terms of the mechanical strength and the resistance reduction of the contact carrier 1. More specifically, as is seen in FIG. 9, in favor of the mechanical strength and the resistance reduction of the contact carrier 1, a vertical distance "x" between two of the adjacent first slits 5, between two of the adjacent second slits 6, and between the first slit 5 and the second slit 6 (adjacent to each other) is preferably about 7 mm to 18 mm. Then, in consideration of the outer diameter D of the contact carrier 1 and the total number S2 of slits (including the first slits 5 and the second slits 6), the range of the inclination angle α is 60°≦α≦80°.

Each of the azimuth angle β of the inclined slit portion 5*b* (of the first slit 5) and the azimuth angle β of the second slit 6 is set within the range of (540/S2)°≦β≦(1440/S2)°.

The lower limit is determined at (540/S2)° for the following reason:

Length of the coil part for the lower limit is defined as 1.5 turns. Therefore, the lower limit smaller than (540/S2)° may cause shortage of the magnetic flux density.

The upper limit is determined at (1440/S2)° for the following reason:

The length of the coil part for the upper limit is defined as 4 turns. With the upper limit greater than (1440/S2)° the resistance may become greater, causing an inconvenience due to heat generation. Moreover, the mechanical strength of the contact carrier 1 may become lower.

The azimuth angle γ of the circumferential slit portion 5*a* of the first slit 5 is set within the range of $(120/S2)° \leqq \gamma \leqq (600/S2)°$, which is determined in terms of the mechanical strength of the contact carrier 1.

The first slits 5 are formed equidistant, while the second slits 6 are also formed equidistant. The inclined slit portion 5*b* (of the first slit 5) and the second slit 6 define therebetween a predetermined circumferential spacing or the azimuth angle δ, as is seen in FIG. 11. The azimuth angle δ is set within the range of $(120/S2)° \leqq \delta \leqq (600/S2)°$, which is determined in terms of the mechanical strength of the contact carrier 1.

Since the lengths of the inclined slit portion 5*b* (of the first slit 5) and the second slit 6 are so reduced as to define the circumferential spacing or the azimuth angle δ between the inclined slit portion 5*b* and the second slit 6, a solid pillar portion 1*c* can be formed between the inclined slit portion 5*b* and the second slit 6, as is seen in FIG. 9. The solid pillar portion 1*c* serves to maintain the mechanical strength of the contact carrier 1. In other words, arrangement of a long circumferential slit may reduce the axial strength of the contact carrier 1. Formation of the solid pillar portion 1*c* contributes to preservation of the axial strength of the contact carrier 1.

The inclined slit portion 5*b* (of the first slit 5) and the second slit 6 overlap axially one another in a predetermined area. The second slit 6 may be so formed as to lie between the two adjacent inclined slit portions 5*b* of the first slits 5.

As is seen in FIG. 10, the linear slits 8 are formed in the contact plate 2. The number of linear slits 8 is the same as that of first slits 5 (namely, ½ S2). With inward extensions of the linear slits 8 being offset with respect to the center O of the contact plate 2, the linear slits 8 are arranged spirally as a whole, as shown in FIG. 10. The contact plate 2 is mounted such that a peripheral-face side end 8*a* of the linear slit 8 mates an end (right end in FIG. 9) of the circumferential slit portion 5*a* of the first slit 5, opposite to the end (left end in FIG. 9) to which the inclined slit portion 5*b* is connected. With the above construction of the contact carrier 1 and the contact plate 2, the linear slit 8 and the first slit 5 communicate with each other.

According to the fourth embodiment, the contact end plate 3 is joined to the second end face 1*b* of the contact carrier 1. Alternatively, a portion corresponding to the contact end plate 3 can be monolithic with the contact carrier 1 to achieve a cup-like contact carrier. In this case, the second slit 6 is formed with the position corresponding to the inner bottom of the contact carrier 1 as reference position, for example. The depth of the cup-like monolithic unit or pot depth corresponds to the length L of the contact carrier 1.

Moreover, according to the fourth embodiment, only the first slit 5 comprises the circumferential slit portion 5*a* and the inclined slit portion 5*b*. Alternatively, the second slit 6 may also comprise a circumferential slit portion and an inclined slit portion. In this case, the circumferential slit portion of the second slit 6 is formed in the second end face 1*b* of the contact carrier 1.

Figure 14:
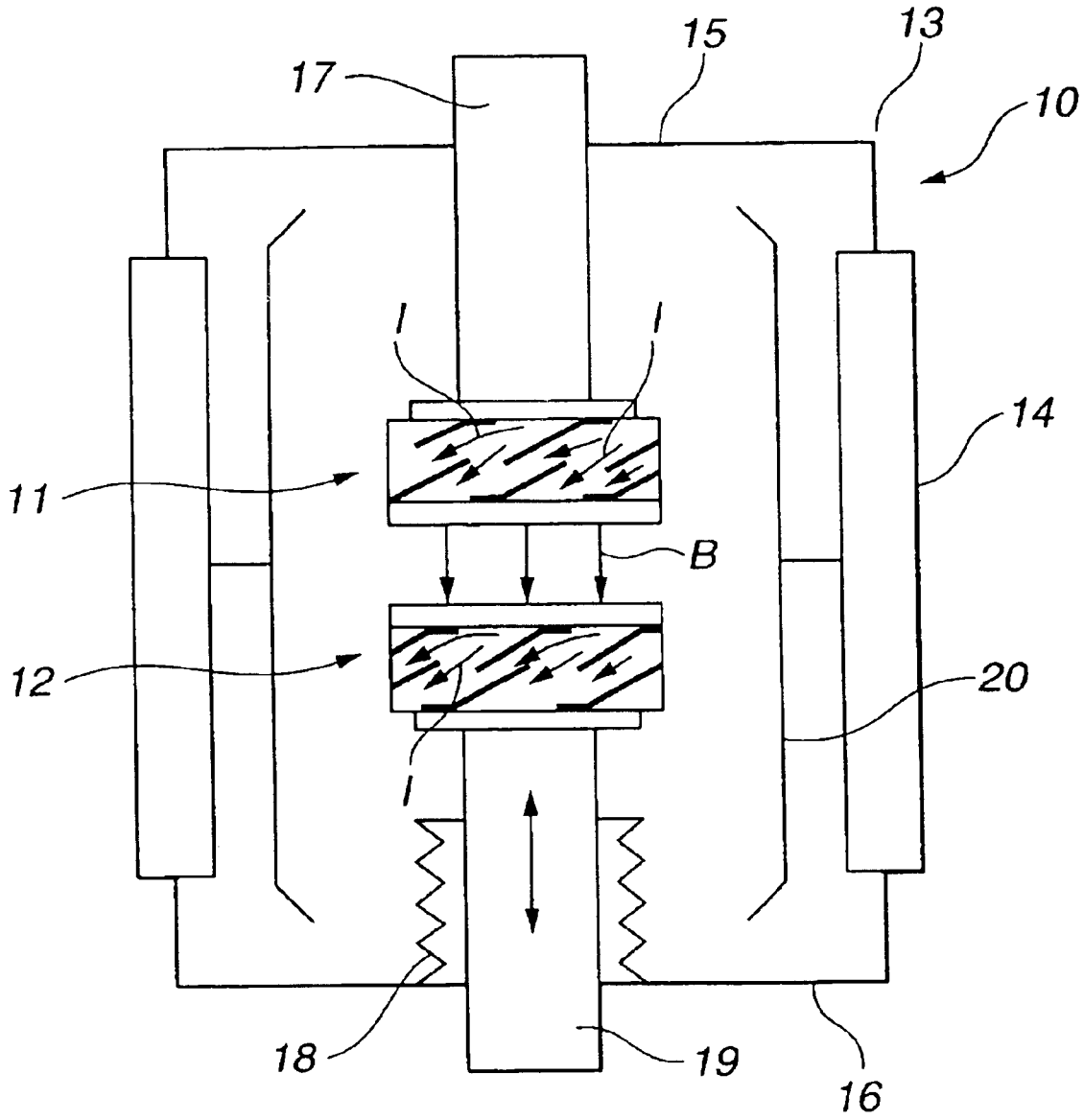
FIG. 14 is a view showing the vacuum interrupter 10 using the contact in FIG. 9.
Figure 15:
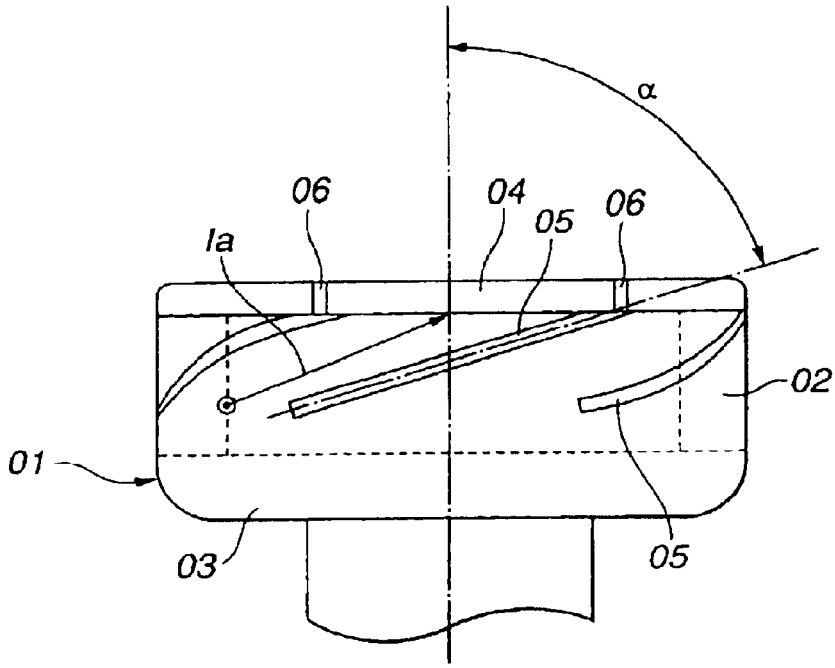
FIG. 15 PRIOR ART
FIG. 15 is a side view of a contact for a vacuum interrupter, according to a related art.
Figure 16:
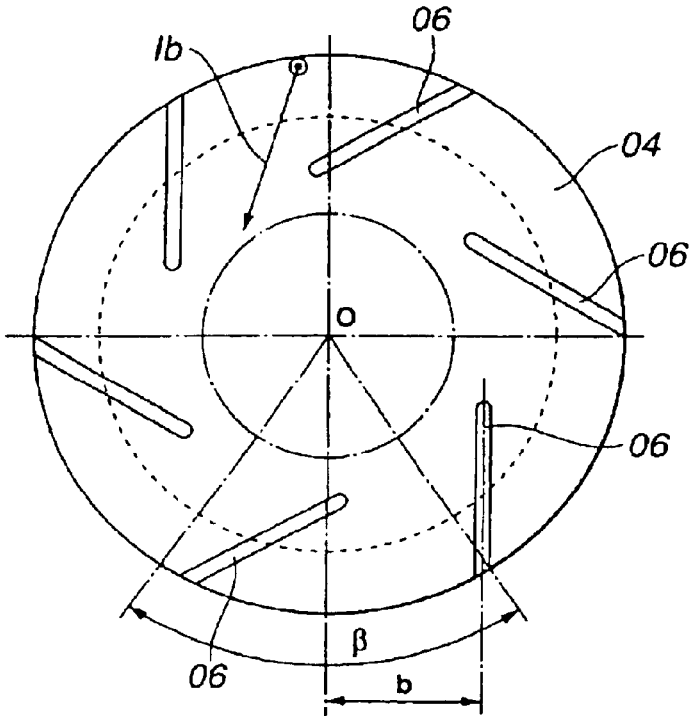
FIG. 16 PRIOR ART
FIG. 16 is a plan view of the contact for the vacuum interrupter shown in FIG. 15.

As is seen in FIG. 14, there is shown the vacuum interrupter 10 using the above first contact 11 and the second contact 12, according to the fourth embodiment of the present invention.

The vacuum interrupter 10 is constituted of the two contacts (namely, the first contact 11 and the second contact 12) as shown in FIG. 9 to FIG. 11, which are so disposed in the vacuum container 13 as to coaxially oppose each other at the gap G as shown in FIG. 12. The gap G is set within the range of $15\ mm \leqq G \leqq 100\ mm$.

The vacuum container 13 comprises the insulating tube 14 made of ceramic, glass or the like. The vacuum container 13 further comprises the first end plate 15 and the second end plate 16 each of which is made of metal for closing both ends of the insulating tube 14, wherein the inside of the vacuum container 13 is evacuated at a high vacuum. The stationary rod 17 is fixedly arranged through the first end plate 15 of the vacuum container 13 to have the front end to which the first contact 11 is fixed as the stationary electrode. The movable rod 19 is arranged movably by the bellows 18 through the second end plate 16 of the vacuum container 13 to have the front end to which the second contact 12 is fixed as the movable electrode. The shield 20 is arranged around the first contact 11 and the second contact 12 in the vacuum container 13.

With the vacuum interrupter 10 having the above construction, the arc is generated between the first contact 11 (electrode) and the second contact (electrode) at the interruption of the current "I". Since the circumferential slit portion 5*a* (insulating layer) lies between the contact plate 2 and the contact carrier 1, the current "I" flows whirlingly along the contact plate 2, then enters the first coil part 7*a* between two of the adjacent inclined slit portions 5*b* of the contact carrier 1, passing through the second coil part 7*b* between the inclined sit portion 5*b* (of the first slit 5) and the second slit 6 and then flowing into the third coil part 7*c* between two of the adjacent second slits 6. Passage of the current "I" through the first coil part 7*a*, the second coil part 7*b*, and the third coil part 7*c* can generate the longitudinal magnetic field B between the contact plate 2 (of the first contact 11) and the contact plate 2 (of the second contact 12). Due to formation of numerous and long current paths, the above construction allows generation of the magnetic field two or more times as much as that generated by the construction having the first slits 5 only. This results in stabilized arc and excellent interrupting performance.

According to the fourth embodiment, each of the first contact 11 and the second contact 12 of the vacuum interrupter 10 as shown in FIG. 14 defines the following dimensions:

EXAMPLE 4

| | |
|---|---|
| 1. Outer diameter D of contact carrier 1: | 80 mm |
| 2. Length L of contact carrier 1: | 27 mm |
| 3. Total number S2 of first slits 5 and second slits 6: * 6 for either first slits 5 or second slits 6. | 12 |
| 4. Inclination angle α of inclined slit portion 5b: | 70° |
| 5. Inclination angle α of second slit 6: | 70° |
| 6. Azimuth angle β of inclined slit portion 5b: | 65° |
| 7. Azimuth angle β of second slit 6: | 65° |
| 8. Azimuth angle γ of circumferential slit portion 5a: | 15° |
| 9. Azimuth angle δ of spacing or portion between inclined slit portion 5b and second slit 6: | 30° |
| 10. Wall thickness W of contact carrier 1: | 8.5 mm |

With the vacuum interrupter 10 defining the dimensions described above, when the first contact 11 and the second contact 12 are disposed coaxially opposing each other at the gap of 40 mm in the Example 4, the magnetic flux density generated substantially in the center portion is 4.2 μT/A. The thus obtained vacuum interrupter 10 provides interrupting performance of 72 kV rated voltage and 31.5 kA rated interrupting current.

Moreover, the following Example 5 is provided, according to the fourth embodiment.

EXAMPLE 5

| | |
|---|---|
| 1. Outer diameter D of contact carrier 1: | 90 mm |
| 2. Length L of contact carrier 1: | 37 mm |
| 3. Total number S2 of first slits 5 and second slits 6: * 6 for either first slits 5 or second slits 6. | 12 |
| 4. Inclination angle α of inclined slit portion 5b: | 72° |
| 5. Inclination angle α of second slit 6: | 72° |
| 6. Azimuth angle β of inclined slit portion 5b: | 75° |
| 7. Azimuth angle β of second slit 6: | 75° |
| 8. Azimuth angle γ of circumferential slit portion 5a: | 20° |
| 9. Azimuth angle δ of spacing or portion between inclined slit portion 5b and second slit 6: | 13° |
| 10. Wall thickness W of contact carrier 1: | 8.5 mm |

With the vacuum interrupter 10 defining the dimensions described above, when the first contact 11 and the second contact 12 are disposed coaxially opposing each other at the gap of 40 mm in the Example 5, the magnetic flux density generated substantially in the center portion is 4.5 $\mu$T/A. The thus obtained vacuum interrupter 10 provides interrupting performance of 72 kV rated voltage and 40.0 kA rated interrupting current.

According to the embodiments of the present invention, the vacuum interrupter using the two contacts has greater intensity of a longitudinal magnetic field generated between the two contacts, allowing uniform distribution of the arc produced at current interruption, resulting in enhanced interrupting performance.

Moreover, according to the embodiments of the present invention, when achievement of the high-voltage heavy-current interrupting performance requires larger diameter of the contact and longer dissociation distance or gap, a necessary and sufficient longitudinal magnetic field can be generated between the contacts, obtaining stable interrupting performance.

Further, according to the fourth embodiment of the present invention, the solid pillar portion is formed between the inclined slit portion (of the first slit) and the second slit, providing greater mechanical strength of the contact carrier than that of the cup-like contact which generates the same magnetic flux density.

Although the present invention has been described above by reference to certain embodiments, the present invention is not limited to the embodiments described above. Modifications and variations of the embodiments described above will occur to those skilled in the art, in light of the above teachings.

The entire contents of basic Japanese Patent Application No. P2001-276172 (filed on Sep. 12, 2001 in Japan) from which priority is claimed and basic Japanese Patent Application No. P2001-281068 (filed on Sep. 17, 2001 in Japan) are incorporated herein by reference, in order to take some protection against mis-translation or omitted portions.

The scope of the present invention is defined with reference to the following claims.

What is claimed is:

1. A contact for a vacuum interrupter, comprising:

a contact plate; and a contact carrier comprising:

a peripheral face which is formed with a plurality of slit portions in such a manner as to form a coil part between two adjacent slit portions of the plurality of slit portions, the coil part flowing a current such that a longitudinal magnetic field is formed in an axial direction of the contact carrier, and a first end face fitted with the contact plate, the first end face being formed with a circumferential slit portion which extends circumferentially between the two adjacent slit portions of the plurality of slit portions and has an end connecting to one of the adjacent slit portions of the plurality of slit portions.

2. The contact for the vacuum interrupter as claimed in claim 1, wherein the contact plate is formed with a slit which connects to the circumferential slit portion.

3. The contact for the vacuum interrupter as claimed in claim 1, wherein when the contact carrier defines an outer diameter D in a following range:

$60\ \text{mm} \leqq D \leqq 200\ \text{mm}$;

the contact carrier defines a length L in a following range:

$0.1D\ \text{mm} \leqq L \leqq 0.5D\ \text{mm}$, each of the slit portions formed in the peripheral face of the contact carrier is defined in number S1 as follows:

$0.03D/\text{mm} \leqq S1 \leqq 0.1D/\text{mm}$, relative to an axis of the contact carrier, each of the slit portions formed in the peripheral face of the contact carrier defines an inclination angle α expressed as below:

$60° \leqq \alpha \leqq 80°$, each of the slit portions formed in the peripheral face of the contact carrier defines an azimuth angle β expressed as below:

$45° \beta \leqq 120°$, and the circumferential slit portion formed in the first end face of the contact carrier defines an azimuth angle γ expressed as below:

$(30/S1)° \leqq \gamma \leqq (270/S1)°$.

4. The contact for the vacuum interrupter as claimed in claim 3, wherein the contact carrier has a wall thickness W in a following range:

$6\text{mm} \leqq W \leqq 12\ \text{mm}$.

5. The contact for the vacuum interrupter as claimed in claim 2, wherein the slit formed in the contact plate is substantially linear and extends radially from a center of the contact plate, and the slit formed in the contact plate connects to a section connecting the circumferential slit portion and the one of the adjacent slit portions which is formed in the peripheral face of the contact carrier.

6. The contact for the vacuum interrupter as claimed in claim 2, wherein the slit formed in the contact plate is substantially linear and extends radially from a center of the contact plate, and the slit formed in the contact plate connects to the end of the circumferential slit portion.

7. The contact for the vacuum interrupter as claimed in claim 2, wherein the slit formed in the contact plate is substantially linear, and extends in such a manner as to be offset from a line passing through a center of the contact plate, the slit formed in the contact plate extends in parallel with the line through the center of the contact plate by a predetermined distance, and the slit formed in the contact plate connects to the end of the circumferential slit portion.

8. The contact for the vacuum interrupter as claimed in claim 1, wherein the contact carrier further comprises a second end face opposite to the first end face, and the second end face of the contact carrier is joined with a contact end plate.

9. The contact for the vacuum interrupter as claimed in claim 1, wherein the contact carrier is monolithic with a contact end plate.

10. The vacuum interrupter as claimed in claim 1, wherein a pair of the contacts are disposed in such a manner as to oppose each other substantially coaxially, the opposing contacts defining a predetermined gap G therebetween in a following range:

15 mm≦G≦100 mm.

11. A vacuum interrupter, comprising:

a first contact fixed to a peak end of a stationary rod which is fixed to a first end plate of a vacuum container; and a second contact fixed to a peak end of a movable rod which is fixed to a second end plate of the vacuum container opposite to the first end plate, the second contact opposing the first contact substantially coaxially in such a manner as to define a predetermined gap G therebetween in a following range:

15 mm≦G≦100 mm, each of the first contact and the second contact, comprising:

a contact plate; and a contact carrier comprising:

a peripheral face which is formed with a plurality of slit portions in such a manner as to form a coil part between two adjacent slit portions of the plurality of slit portions, the coil part flowing a current such that a longitudinal magnetic field is formed in an axial direction of the contact carrier, and a first end face fitted with the contact plate, the first end face being formed with a circumferential slit portion which extends circumferentially between the two adjacent slit portions of the plurality of slit portions and has an end connection to one of the two adjacent slit portions of the plurality of slit portions.

12. The vacuum interrupter as claimed in claim 11, wherein the contact plate is formed with a slit which connects to the circumferential slit portion.

13. The vacuum interrupter as claimed in claim 11, wherein when the contact carrier defines an outer diameter D in a following range:

60 mm≦D≦200 mm;

the contact carrier defines a length L in a following range:

0.1D mm≦L≦0.5D mm, each of the slit portions formed in the peripheral face of the contact carrier is defined in number S1 as follows:

0.03D/mm≦S1≦0.1D/mm, relative to an axis of the contact carrier, each of the slit portions formed in the peripheral face of the contact carrier defines an inclination angle α expressed as below:

60°≦α≦80°, each of the slit portions formed in the peripheral face of the contact carrier defines an azimuth angle β expressed as below:

45°≦β≦120°, and the circumferential slit portion formed in the first end face of the contact carrier defines an azimuth angle γ expressed as below:

(30/S1)°≦γ≦(270/S1).

14. The vacuum interrupter as claimed in claim 13, wherein the contact carrier has a wall thickness W in a following range:

6 mm≦W≦12 mm.

15. A vacuum interrupter, comprising:

two contacts disposed coaxially to oppose each other, a predetermined gap G between the two contacts being given by 15 mm≦G≦100 mm, each of the two contacts comprising:

a plate;

a carrier having a first end face mounted to the plate; and slits formed in the carrier, the slits defining a coil portion in the carrier, a current passing through the coil portion generating a longitudinal magnetic field along an axial direction of the carrier, the slits comprising a first slit which comprises:

a circumferential slit portion formed in the first end face of the carrier, and an inclined slit portion formed in a peripheral face of the carrier at a predetermined inclination angle α with respect to an axis of the carrier and connected to an end of the circumferential slit portion, wherein the slits further comprises a second slit formed in the peripheral face of the carrier at the predetermined inclination angle α and extending from an axially middle position of the carrier.

16. The vacuum interrupter as claimed in claim 15, wherein the second slit has an opening in the second end face of the carrier.

17. The vacuum interrupter as claimed in claim 15, wherein when an outer diameter D of the carrier is 60 mm≦D≦200 mm, a length L of the carrier is given by 0.2D mm≦L≦D mm, a total number S2 of the first slits and the second slits is given by 0.1D /mm≦S2≦0.2D /mm, the inclination angle α is given by 60°≦α≦80°, an azimuth angle β of the inclined slit portion of the first slit and the second slit is given by (540/S2)°≦β≦(1440/S2)°, an azimuth angle δ between the inclined slit portion of the first slit, and the second slit is given by (120/S2)°≦δ≦(600/S2)°, and an azimuth angle γ of the circumferential slit portion of the first slit is given by (120/S2)°≦γ≦(600/S2)°.

18. The vacuum interrupter as claimed in claim 17, wherein a wall thickness W of the carrier is 6 mm≦W≦12 mm.

19. The vacuum interrupter as claimed in claim 15, wherein the second slit comprises a circumferential slit portion (N/A) formed in a second end face (1*b*) of the carrier.

* * * * *